US005132030A

United States Patent [19]

Marx

[11] Patent Number: 5,132,030

[45] Date of Patent: Jul. 21, 1992

[54] FIRE-EXTINGUISHING SUBSTANCE

[76] Inventor: Günther Marx, D-5431 Ruppach-Goldhausen, Fed. Rep. of Germany

[21] Appl. No.: 459,692

[22] PCT Filed: Nov. 8, 1988

[86] PCT No.: PCT/DE88/00692

§ 371 Date: Jan. 26, 1990

§ 102(e) Date: Jan. 26, 1990

[87] PCT Pub. No.: WO89/04694

PCT Pub. Date: Jun. 1, 1989

[30] Foreign Application Priority Data

Nov. 19, 1987 [DE] Fed. Rep. of Germany ..... 3739177

[51] Int. Cl.[5] ..... A62D 1/00

[52] U.S. Cl. ..... 252/2; 252/8 D; 169/44; 169/46; 169/47

[58] Field of Search ..... 252/2, 8 D; 169/44, 169/46, 47

[56] References Cited

U.S. PATENT DOCUMENTS

| | | | |
|---|---|---|---|
| 3,080,316 | 3/1963 | Petertyl et al. | 252/2 |
| 4,070,315 | 1/1978 | Mehta et al. | 260/28.5 |
| 4,664,843 | 5/1987 | Burba, III et al. | 252/315.5 |
| 4,790,954 | 12/1988 | Burba, III et al. | 252/315.5 |

FOREIGN PATENT DOCUMENTS

| | | |
|---|---|---|
| 1211946 | 3/1966 | Fed. Rep. of Germany . |
| 2814033 | 10/1978 | Fed. Rep. of Germany . |
| 1159404 | 6/1958 | France . |
| 1519576 | 8/1978 | United Kingdom . |

*Primary Examiner*—Robert L. Stoll
*Assistant Examiner*—N. Bhat
*Attorney, Agent, or Firm*—John F. A. Earley; John F. A. Earley, III

[57] ABSTRACT

A fire extinguishing means based on a combination of various clay minerals, with the clay mineral mixture containing at least a certain amount of smectite, kaolinite as well as clay minerals from the mica group.

14 Claims, No Drawings

FIRE-EXTINGUISHING SUBSTANCE

DESCRIPTION

The invention refers to the use of a clay mineral mixture as a fire-extinguishing substance. Typical fire-extinguishing substances are water or organic foams.

It results from DE-AS 1 211 946 that in addition, chemical material and material mixtures, such as viscosity-increasing substances, among others, clays or gel formers for example, as well as gas-forming materials, for example sodium hydrogen carbonate for example, were used to make water more effective for fire fighting. A disadvantage of using clays is that they merely soak up water slowly and cause abrasion of the pump equipment (Column 1, lines 13 to 15 of the DE-AS 1 211 946).

The fire extinguishing substances proposed in DE-AS 1 211 946 contains $CO_2$-releasing salts in combination with organic acids and as mica components flaked or rolled up and then granulated vermiculite. In this case also, however, a plastic mass that can only be handled with difficulty is created.

A dry chemical mixture as a fire extinguishing foam is known from the DE-PS 570 456. The mixture consists of aluminum sulphate, sodium carbonate and saponin, to which from 8 to 35% of a kaoline additive can also be added according to Page 1, lines 50 to 55 which, however reduces the foam productiveness. Besides this consequence, the familiar dry chemical products mixture did not gain acceptance because fire extinguishing foams cannot be made available in large quantities for forest fire fighting, for example.

The fire extinguishing substances known from the DE-PS 608 037 consist of artificial, inorganic, porous, active masses loaded with extinguishing fluid, with carbontetrachloride as the extinguishing fluid. For practical feasibility, the use of carbon tetrachloride must already be excluded at present due to environmental criteria.

A dry fire extinguishing powder of a bicarbonate base for special use against burning, pyrophorous liquids, such as metal alkyls and particularly triethyl and methyl aluminum and boron has been made public by the DE-AS 1 130 294, with up to 25% alumina, bentonite, fuller earth, halloysite and silicic acid gel intended as adsorption agents (Column 3, lines 1 through 6). In this dry fire extinguishing powder, the burning metal alkyls are to be provided with a coating and the fire site thus choked off. It can therefore not be used for large surface fires.

A fire choking effect should also be obtained with the fire extinguishing substances according to the DE-PS 746 963 as well (Page 1, lines 21 to 25), for which the substances are to consist of a mixture of sand and an alkali earth carbonate. Most of the aforementioned fire extinguishing substances contain considerable chemical components and for this reason, have not gained acceptance particularly because of environmental criteria. Furthermore, in the form of foams or plastic masses they are not suited to extinguish large surface fire sites.

The present invention is, in light of this, based on the task of offering a fire extinguishing substance that also can be used or is suited for use in large quantities particularly for fighting large surface fires, with the substance being easy to handle and, above all, it should not have any environmentally damaging components; moreover, an attempt is being made to provide a fire extinguishing substance that not only displays an optimal fire extinguishing effect but also, beyond the fulfillment of this function, is as tolerable as possible for the environment and needs no separate disposal as is the case for chemical-based fire extinguishing substances.

For large surface fires such as forest fires or fires at industrial plants, there is often a considerable emission of toxic substances through the smoke gases, and this therefore represents a further feature of the present invention, namely to develop the fire extinguishing substance preferably in such a way that this toxic substance emission is also reduced, at least partially.

The invention is based on the perception that the familiar disadvantages in the present state of the art can be overcome if, instead of a single clay mineral serving as an adsorption agent for other components of the fire extinguishing substance, such as kaolinite, a selected combination of various clay minerals is used that complement each other in a synergic fashion with respect to their individual characteristics and effects. While, for example, the use of a kaolinite, as is referred to in the DE-PS 570 456, causes extreme coagulation of the fire extinguishing substances or a bentonite, as referred to in the DE-AS 1 130 294, causes an undesirably high thixotropy of the dry powder that comes into contact with liquid, excellent stable suspensions are achieved surprisingly from a clay mineral mixture containing smectite, kaolinite as well as clay minerals from the mica group, as soon as the material comes into contact with or is mixed with the extinguishing liquid (water as a rule). By obtaining a stable suspension the substance according to the invention becomes usable on a large scale.

A clay mineral mixture of the type mentioned, of montmorillonite, illite and kaolinite is perhaps known from GB-A-1 519 576, but it is prepared there together with fibers and water in particle forms that are then burned. No incitement to use the clay mineral mixture as fire extinguishing substances results from this.

The synergistic mutually complementary characteristics of the single clay minerals according to the invention produce, after adding water, suspensions that neither solidify thixotropically nor tend to coagulate and thus sedimentation of the solid particles. Such a clay mineral mixture is able to take in considerable quantities of water, with the preferred water/solid ratio indicated as from 10:1 to 3:1, in which outstandingly stable suspensions result even with these large quantities of water. The confection of the fire extinguishing substances in the form of suspensions after adding of water has been given particular importance. As a rule, this will also represent a preferred form of application. Yet it is also possible to use the fire extinguishing substances as powder, concerning which further details are given below.

The required components smectite, kaolinite and mica, and particularly illite are preferably mixed together in the proportions such that the clay mineral mixture has the following composition by % weight, where the sum of the individual components always is 100:

| | |
|---|---|
| smectite | 20–60, preferably 30–50 |
| kaolinite | 5–40, preferably 10–25 |
| mica | 5–30, preferably 8–20 |

with a residue of quartz and/or feldspars as well as accessory ingredients of the mixture. Depending on portion of the individual clay minerals, the mixture can then take in a non-flammable extinguishing liquid, particularly water preferably with water/solid ratio of between 10:1 and 3:1.

The capacity to store water as well as the extinguishing effect are improved the finer the form in which the clay minerals are available or prepared, with particles having an average granule diameter of under 500 μm preferred, which disperse down to ranges of 0.05 μm very quickly in a liquid or steam environment (granule range of 0.05–20 μm, for example) and then provide huge surfaces. A decisive advantage over known fire extinguishing substances also consists in the fact that the water binding ability can now be maintained over a much longer period of time than was previously the case. On the one hand. the fire extinguishing substance is thus available longer for fire fighting or fire prevention but can, on the other hand, also safely prevent the fire from breaking out again, since the solid particles can also take in water again at a later point. The means accordingly proves to be practically reversible.

The fire extinguishing substance is also distinguished by being particularly easy to handle. Depending on the solid portion within the clay mineral-water-suspension the volumetric weight of 1.0 g/cm$^3$ increases to 1.05 to 1.5 g/cm$^3$ or even more. The falling speed thus increases, e.g. if the extinguishing substance is thrown from an airplane, and the danger is reduced that the extinguishing means gets carried off by winds without having engaged its extinguishing effect on the fire site.

By an optimal water storage in the individual clay mineral particles, considerable minimizing of vaporization losses due to the heat of the fire is provided for as well.

Through the spontaneous readiness of the clay mineral mixture to take in extinguishing fluid, the possibility is also created to first carry the material out dry and to undertake the actual extinguishing only later through spraying it with extinguishing water, in which case a longer effectiveness results from the high water adhesion to the clay mineral particles.

In addition to the already mentioned clay minerals of the smectite group (including among others, montmorillonite, beidillite, saponite and hectorite), of the kaolinite group (including, among others, kaolinite, halloysite and serpentine) as well as the clay minerals of the mica group (including, above all, illite and so-called mixed layer) the clay mineral mixture according to the invention can also have nature-related or added portions of quartz, opaque and/or feldspar as well as accessory ingredients of the mixture.

Among the accessory ingredients of the mixture are the type of materials that bind oxygen, particularly at high temperatures of approx. 1000° C., such as magnetite. The means also causes a reduction in toxic smoke gas and soil components by adsorption, absorption and/or catalytic conversion. Through additives, particularly calcium carbonate or magnesium carbonate, for example in the form of lime or dolomite, the fire choking effect of the means is further increased, particularly through the release of $CO_2$ in the fire or the forming of $Ca(OH)_2$ and/or $Mg(OH)_2$ after contact with water. As a result, the fire extinguishing substance not only displays its effect with regard to the actual fire fighting, but moreover in the disposal of toxic components in the air and in the ground.

The fire extinguishing substance itself is fireproof up to approx. 1200° C. and higher, i.e. it can stand even the highest forest fire temperatures and is preferably sprayed or thrown in the finest dispersed form as a suspension on the fire surfaces to be extinguished. Even if the water vaporizes after a certain length of time, the clay mineral components still adhere to the forest surfaces (trees) or elements where the fire is extinguished and form a sort of "protective layer", depriving the fire of "nourishment" just as when first used, in the form of a dry powder.

Due to the exclusively natural, mineral components, the substance is totally harmless for people, animals or plants. As described above, it can even serve to improve damaged soils afterwards, for example when it is washed away by a subsequent rain.

With additives such as sodium carbonate or water glass, the water storing capacity can be further influenced positively. The expert has access to a selection of other substances that act to promote dispersion and/or the water storing capacity. Among these are the cationic or anionic agents that have a liquefying effect, such as sodium silicate or surfactants.

Among the accessory quantity components are also those such as magnetite ($Fe_3O_4$), which is capable of binding oxygen particularly at high temperatures, as prevail in forest fires. It is obvious that a further contribution to the containment of a fire is made by such and oxygen binding.

Surprisinly, the means could be adjusted in such a way that the addition of salt-containing sea-water as extinguishing liquid to a clay mineral mixture according to the invention also catalytically influences its activation with regard to the water storing capacity or dispersion of the particles.

By a dispersion of the particles, specific surfaces of over 50m$^2$/g can be reached with grain sizes of less than 0.05 μm.

In addition to the already mentioned confectioning in the form of dry powder or suspensions for throwing out of airplanes or the like, the fire extinguishing means can naturally also be brought out using typical fire vehicles or corresponding apparatuses. Because of the high stability of the suspension, it is guaranteed that the material will not sediment even on longer transport distances or during longer rest periods, and can thus even then still unfurl its full effectiveness.

Further characteristics of the invention stem from the other characteristics given in the patent claims.

I claim:

1. A clay mineral mixture for extinguishing a fire having the following composition by weight percent, where the sum of the individual components is always 100:

| | |
|---|---|
| smectite | 20–60, |
| kaolinite | 5–40, |
| mica | 5–30, |

the clay mineral mixture further comprising a residue of quartz or feldspars as well as accessory ingredients.

2. A clay mineral mixture for extinguishing a fire comprising sectite, kaolinite and clay minerals from the mica group, the clay mineral mixture having the following composition by weight percent, where the sum of the individual components is always 100:

| | |
|---|---|
| smectite | 20–60, |
| kaolinite | 10–25 |
| mica | 8–20 |

the clay mineral mixture further comprising a residue of quartz or feldspars as well as accessory ingredients, the quartz portion being 10–25% by weight of the total mixture, the portion of feldspar or accessory ingredients of the mixture being 5–10% by weight, the accessory ingredients of the mixture being materials that bind oxygen, particularly at high temperatures of up to 1000 C., such as magnetite, or which may store toxic smoke gas components and ground components, for example calcium carbonate or magnesium carbonate in the form of lime or dolomite, the average diameter of the solid particles in the mixture being less than 500 μm, the mixture being in the form of a stable suspension, with a water/solid ratio of between 10:1 and 3:1, means added to the clay mineral mixture for catalytically influencing the water storing capacity thereof, the clay mineral mixture further comprising sodium carbonate or water glass in a quantity of not more than 3% by weight of the total solid portions, an agent having a dispersing or liquefying effect on the solid particles, the dispersing or liquefying agent being sodium silicate, sodium hydroxide, or a melamine resin, and the water portion of the mixture being formed at least partially from sea-water.

3. The clay material mixture of claim 1, the quartz portion being 10–25% by weight of the total mixture.

4. The clay material mixture of claim 1, the portion of opaque, feldspar or accessory ingredients of the mixture being 3–15% by weight.

5. The clay material mixture of claim 1, the accessory ingredients of the mixture being materials that bind oxygen, particularly at high temperatures of up to 1000° C., such as magnetite, or which may store toxic smoke gas components and ground components, for example calcium carbonate or magnesium carbonate in the form of lime or dolomite.

6. The clay material mixture of claim 1, the average diameter of the solid particles in the mixture being less than 500μm.

7. The clay material mixture of claim 1, the mixture being in the form of a stable suspension, with a water/solid ratio between 10:1 and 3:1.

8. The clay material mixture of claim 7, further including means added to the clay material mixture for catalytically influencing the water storing capacity thereof.

9. The clay material mixture of claim 8, the clay material mixture further comprising sodium carbonate or water glass in a quantity of not more than 3% by weight of the total solid portions.

10. The clay material mixture of claim 7, further including an agent having a dispersing or liquefying effect on the solid particles in the suspension.

11. The clay material mixture of claim 10, the dispersing or liquefying agent being sodium silicate, sodium hydroxide, or a melamine resin.

12. The clay material mixture of claim 7, the water portion of the mixture being formed at least partically from sea-water.

13. A clay mineral mixture for extinguishing a fire mineral mixture having the following composition by weight percent where the sum of the individual components is always 100:

| | |
|---|---|
| smectite | 30–50, |
| kaolinite | 10–25, |
| mica | 8–20, |

the clay mineral mixture further comprising a residue of quartz or feldspars as accessory ingredients.

14. A method of extinguishing a fire with a clay mineral mixture comprising smectite, kaolinite, and clay minerals from the mica group, the clay mineral mixture having the following composition by weight percent, where the sum of the individual components is always 100:

| | |
|---|---|
| smectite | 20–60, |
| kaolinite | 5–40, |
| mica | 5–30, |

the clay mineral mixture further comprising a residue of quartz or feldspar as accessory ingredients, the clay mineral mixture being in the form of a stable suspension with a water/solid ratio of between 10:1 and 3:1, which includes the steps of applying the suspension to a fire, and extinguishing the fire with the suspension.

* * * * *